US009739531B2

(12) United States Patent
Goulet

(10) Patent No.: US 9,739,531 B2
(45) Date of Patent: Aug. 22, 2017

(54) WARDROBE FOR DRYING CLOTHING AND SPORTS EQUIPMENT

(71) Applicant: Adaptive Storage Solutions Inc., Toronto (CA)

(72) Inventor: Richard Goulet, Toronto (CA)

(73) Assignee: ADAPTIVE STORAGE SOLUTIONS INC., Toronto, Ontario (CA)

( * ) Notice: Subject to any disclaimer, the term of this patent is extended or adjusted under 35 U.S.C. 154(b) by 271 days.

(21) Appl. No.: 14/525,135

(22) Filed: Oct. 27, 2014

(65) Prior Publication Data

US 2015/0113827 A1 Apr. 30, 2015

Related U.S. Application Data

(63) Continuation-in-part of application No. 14/106,463, filed on Dec. 13, 2013, now abandoned, which is a continuation-in-part of application No. 14/064,051, filed on Oct. 25, 2013, now abandoned.

(51) Int. Cl.

| | |
|---|---|
| ***F26B 3/00*** | (2006.01) |
| ***F26B 5/00*** | (2006.01) |
| ***A47B 61/00*** | (2006.01) |
| ***F26B 21/00*** | (2006.01) |
| ***F26B 25/14*** | (2006.01) |
| ***F26B 9/06*** | (2006.01) |
| ***F26B 20/00*** | (2006.01) |

(52) U.S. Cl.

CPC ..... *F26B 5/00* (2013.01); *A47B 61/00* (2013.01); *F26B 9/06* (2013.01); *F26B 20/00* (2013.01); *F26B 21/004* (2013.01); *F26B 25/14* (2013.01)

(58) Field of Classification Search

CPC .. F26B 21/00; F26B 5/00; F26B 9/003; F26B 9/06; A47B 81/00; A47B 87/0223; A47B 61/00; D06F 58/10; D06F 58/28; D06F 58/14; A45C 7/0063

USPC ..... 34/443

See application file for complete search history.

(56) References Cited

U.S. PATENT DOCUMENTS 2,701,921 A * 2/1955 Strongson ..... D06F 58/14 219/400

5,323,897 A * 6/1994 Sperber ..... D06F 95/002 206/287

(Continued)

*Primary Examiner* — Kenneth Rinehart
*Assistant Examiner* — Bao D Nguyen
(74) *Attorney, Agent, or Firm* — Venjuris, PC

(57) ABSTRACT

The present invention relates to a wardrobe for storage and drying of sports equipment and/or clothes. This wardrobe has an opening, an air circulation fan and an exhaust vent at the bottom, an intake vent at the top, and suspending means for suspending articles such as sports equipment or clothes. Turning on the fan activates active drying of the articles. Additionally, the present invention relates to a method of storing and drying articles comprising suspending the articles in a wardrobe, the interior of said wardrobe comprising an air circulation fan and an exhaust vent at the bottom; an intake vent at the top; and suspending means for suspending the articles. The articles that are difficult or take more time to dry can be placed closest to the fan. The wardrobe can have a rigid or flexible interior cavity and the flexible wardrobe can be capable of hanging on a rod and additionally can be packed in a bag with or without a kit with support poles and feet.

10 Claims, 17 Drawing Sheets

(56) References Cited

U.S. PATENT DOCUMENTS

| | | | | |
|---|---|---|---|---|
| 5,528,912 | A * | 6/1996 | Weber | D06F 58/14 223/51 |
| 6,134,806 | A * | 10/2000 | Dhaemers | A43D 3/14 34/404 |
| 2005/0016012 | A1 * | 1/2005 | Yang | D06F 58/10 34/486 |

* cited by examiner

WARDROBE FOR DRYING CLOTHING AND SPORTS EQUIPMENT

CROSS-REFERENCE TO RELATED APPLICATION

This application is a continuation-in-part of application Ser. No. 14/106,463 filed on Dec. 13, 2013 which is a continuation-in-part of application Ser. No. 14/064,051, filed on Oct. 25, 2013, both of which are incorporated herein by reference in their entireties.

FIELD OF THE INVENTION

The present invention relates to a drying apparatus and more specifically to a wardrobe for storage, drying and airing of sports equipment and/or clothes.

BACKGROUND OF THE INVENTION

After use, sports equipment and attire is generally damp from sweat, and exposure to air is desirable in order to dry the equipment. However, it can take hours for equipment to dry on its own and equipment wet with sweat may have an unpleasant odour which continues to be evident during the drying process, and this odour generally becomes worse after repeated use of the equipment.

At its simplest, sports equipment is typically dried by removing the equipment from its sports bag and airing it by laying it out on a floor, shelves or drying racks strong enough for the weight of the equipment. Since sports equipment can be of various configurations, some pieces dry better than others and some may not dry before being used again. For example, fingers of sports gloves and the inside of boots and skates are particularly difficult to dry.

An example of a product for storage of sports equipment is the ALLSPORT HOT LOCKER™ which is a metal cabinet with the appearance of a gym or school locker.

There are tree shaped units for sports equipment on which sports equipment is hung to air out. There is a ROCKET SPORT DRYER™ which includes a tree for putting equipment on, a bag to cover the tree and then a high powered fan to blow into the bag. There is a DRYLOCKER™ which is a sports bag with a fan to attempt to circulate some air around the equipment packed into the bag.

THE OCTOPUS™ hanger has various cords with clamps to clamp on the hockey equipment. The HOCKEY HANG-OUT™ is a hanging square shaped sheet with rows of pouches for placing the various pieces of equipment into.

Sometimes equipment is stored in the home as far as possible from the main traffic areas of the house, such as in the basement, and sometimes equipment is stored in the garage or shed, and there are even cargo boxes for transporting equipment outside of a vehicle, e.g. the STOW-AWAY® cargo box.

None of these examples address the issue of odour of the equipment and most provide only storage and do not provide additional drying assistance.

SUMMARY OF THE INVENTION

The present invention relates to a wardrobe for storage, drying and airing of sports equipment and/or clothes. An embodiment of the present invention is a wardrobe having an inner cavity extending from the top of the wardrobe to the bottom of the wardrobe, said wardrobe comprising: at least one door; an air intake vent at the top; an air exhaust vent at the bottom; an air circulation fan at the bottom in the inner cavity, said fan capable of being turned on and off; and one or more suspending means in the inner cavity for suspending one or more articles. In a further embodiment of the present invention, the wardrobe additionally comprises a variable speed switch for adjusting the speed of the fan.

In a specific embodiment, the fan is electric and turned on and off with a switch preferably on the outside of the wardrobe or with a timer inside or outside of the wardrobe. The suspending means are selected from the group comprising: bars, hooks, clamps and hangers. The articles to be suspended are sports equipment or clothing or sports equipment and clothing. The suspending means closest to the fan are capable of suspending the articles that require the most time to dry when said articles contain moisture.

In an embodiment of the present invention there is a wardrobe having an inner cavity extending from the top of the wardrobe to the bottom of the wardrobe, said wardrobe comprising: at least one door; an air intake vent at the top; an air exhaust vent at the bottom; an air circulation fan at the bottom in the inner cavity, said fan capable of being turned on and off; and one or more suspending means in the inner cavity for suspending one or more articles, in which the suspending means comprise at least a first horizontal bar adjacent the bottom with hooks for suspending hockey skates and hockey gloves, and above said first bar, a second horizontal bar moulded for suspending shoulder pads.

In an embodiment of the present invention there is a wardrobe with at least one door and with a fan in the bottom of the wardrobe, wherein when said fan is on and the doors are closed, air enters through an intake vent located near or at the top of the wardrobe and exits out an exhaust vent located near or at the bottom of the wardrobe.

A further embodiment of the present invention is a method of drying one or more articles comprising the steps of: suspending one or more articles in a wardrobe having suspending means for suspending the articles, said wardrobe also comprising at least one door, an air circulation fan and an exhaust vent at the bottom, and an intake vent at the top; closing the doors; and turning on the fan.

An embodiment of the present invention is a wardrobe having an inner cavity extending from a top of the wardrobe to a bottom of the wardrobe, said wardrobe comprising: an air intake vent at the top; an air exhaust vent at the bottom; an air circulation fan at the bottom; and at least one access to the inner cavity, said access capable of being opened and closed. The wardrobe may further comprise an active charcoal filter between the air circulation fan and the air exhaust vent.

Activation means for the circulation fan may comprise one or more of the following: an on/off switch, a timer and a three speed variable switch.

The inner cavity of the wardrobe may be rigid and the at least one access may be one door or two doors. And a heater may optionally also be included at the top of the wardrobe.

The inner cavity of the wardrobe may be flexible and the at least one access may be a flap capable of being opened and closed by a zipper.

The flexible wardrobe may have a mesh cover above the air intake vent, the mesh cover comprising one or more slots sized for insertion of scented sheets, wherein the air intake vent comprises a hard panel with ventilation holes that are larger at the slots.

The flexible wardrobe may have a wardrobe hanging means at the top of the wardrobe for hanging the wardrobe or support poles within the inner cavity resting on support feet under the bottom of the wardrobe or both.

The flexible wardrobe may further comprise a packing bag integral to the wardrobe in which the wardrobe fits, wherein the bottom of the packing bag is also the bottom of the wardrobe. This packable flexible wardrobe may have a wardrobe hanging means at the top of the wardrobe for hanging the wardrobe or support poles within the inner cavity resting on support feet under the bottom of the wardrobe or a wardrobe hanging means at the top of the wardrobe for hanging the wardrobe and a kit containing support poles and support feet.

An embodiment of the present invention is a flexible or rigid wardrobe with an inner cavity, a fan and an exhaust vent in a bottom of the wardrobe, an intake vent at a top of the wardrobe, and at least one access to the inner cavity, said access capable of being opened and closed, wherein when the fan is on and the access is closed, air enters through the intake vent and exits out the exhaust vent.

An embodiment of the present invention is a method of drying one or more articles comprising the steps of:

hanging one or more articles in an inner cavity extending from a top of a wardrobe to a bottom of a wardrobe, said wardrobe comprising at least one access to the inner cavity, said access capable of being opened and closed, an air circulation fan and an exhaust vent at the bottom of the wardrobe, and an intake vent at the top of the wardrobe;

closing the access; and turning on the fan.

BRIEF DESCRIPTION OF THE FIGURES

These and other aspects of the present invention will be apparent from the brief description of the drawings and the following detailed description in which.

DETAILED DESCRIPTION OF THE INVENTION

Figure 1:
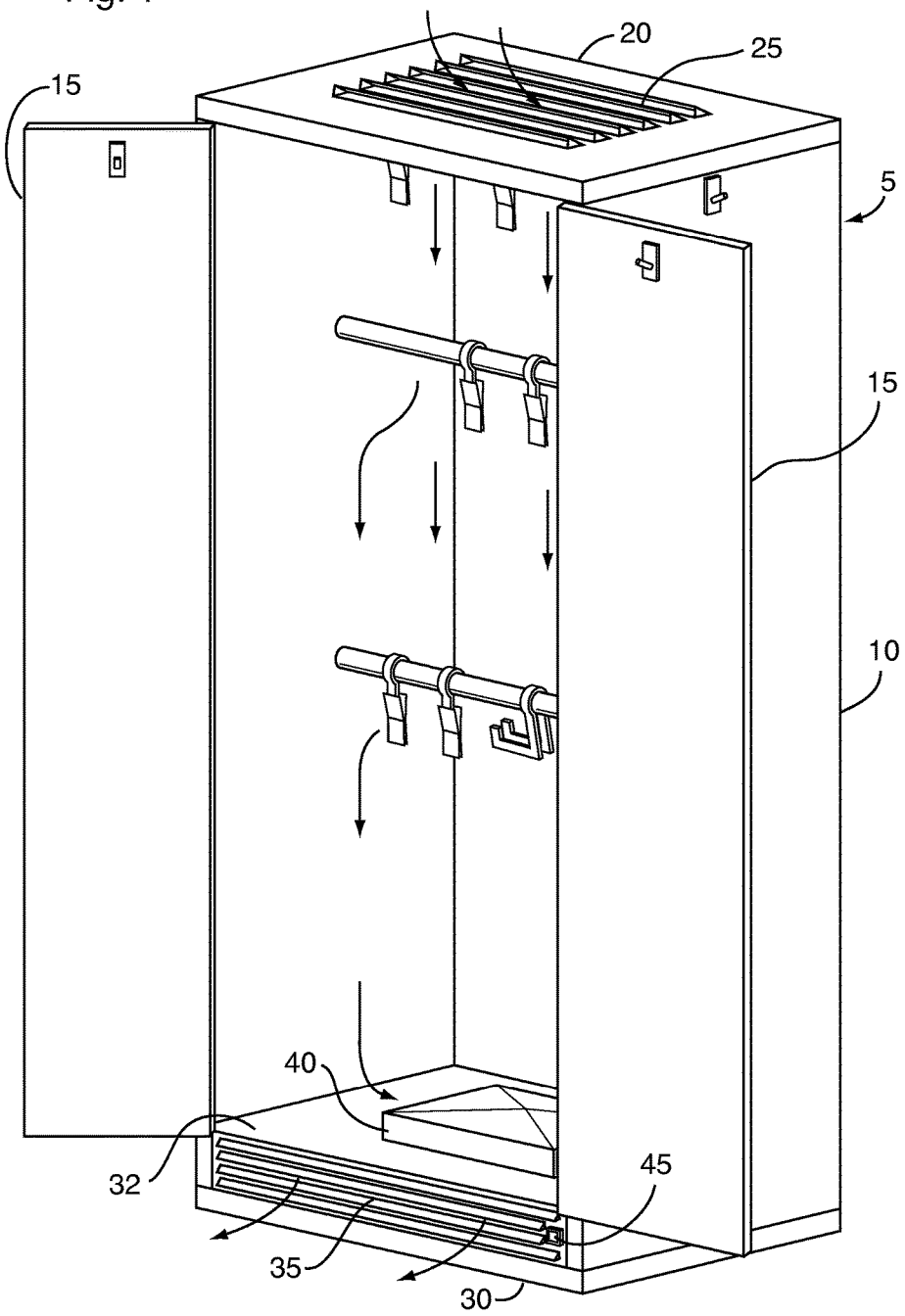
FIG. 1 is a perspective view of an embodiment of a wardrobe of the present invention with doors open.

FIG. 1 shows a wardrobe 5 of an embodiment of the present invention comprising a body 10 with a top 20, bottom 30 and doors 15. It is understood that there may be one or more doors to access the inner cavity of the wardrobe. The top 20 additionally comprises a top vent 25. On a raised floor 32 is a filter holder 40 and underneath the floor 32 is an air circulation fan (not shown) which exhausts through a lower vent 35 and the fan is turned on or off or set by a switch activated with button 45.

In an embodiment, button 45 can be a toe tap rocker switch for ease of use with a foot tap. The switch for turning the fan on and off can be adapted to alternatively be a timer, for example with 2 and 3 hour time settings, so that the fan is on for a specific amount of time. In addition, the switch may alternatively be a variable speed switch, which can adjust the speed of the fan to 0 or from 50 to 100 CFM ("cubic feet per minute"). While the switch is shown near the location of the fan, it is understood that the switch may be located elsewhere on the wardrobe and that the fan may be turned on or off or set by remote control.

Figure 2:
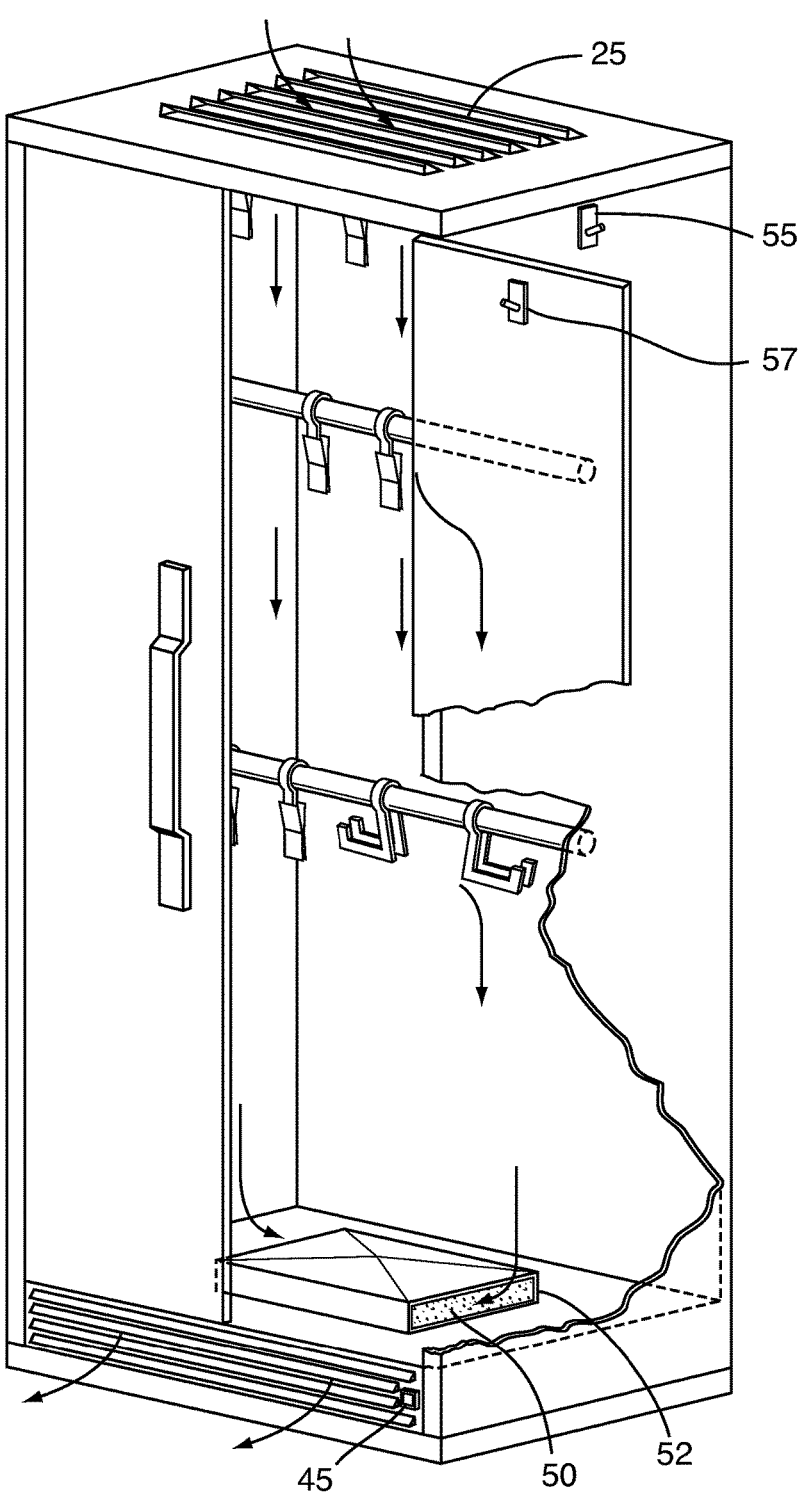
FIG. 2 is a perspective partial breakaway view drawing of an embodiment of a wardrobe of the present invention with one door closed.
Figure 3:
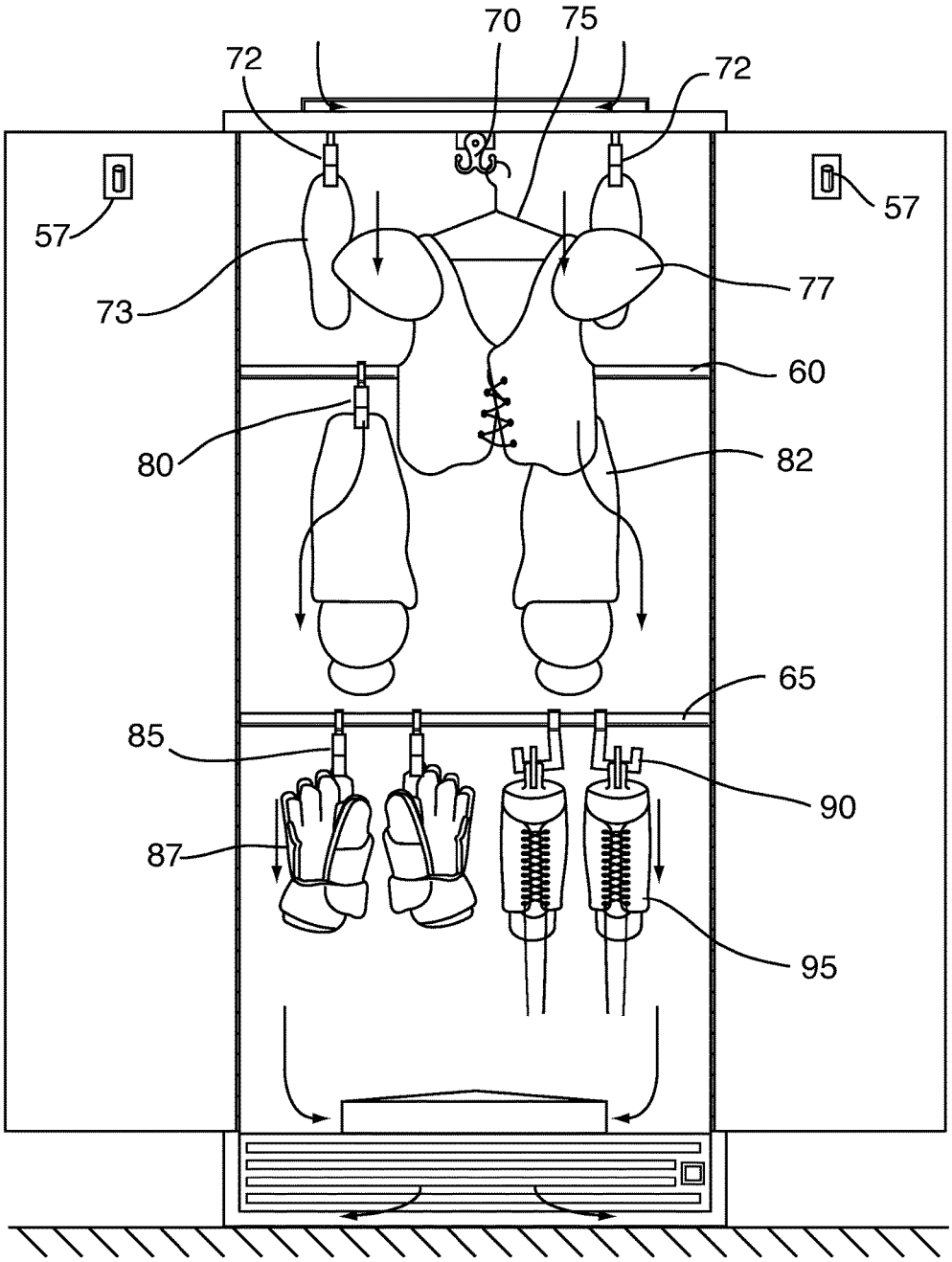
FIG. 3 is a front view of an embodiment of a wardrobe of the present invention with open doors and and hockey equipment.
Figure 4:
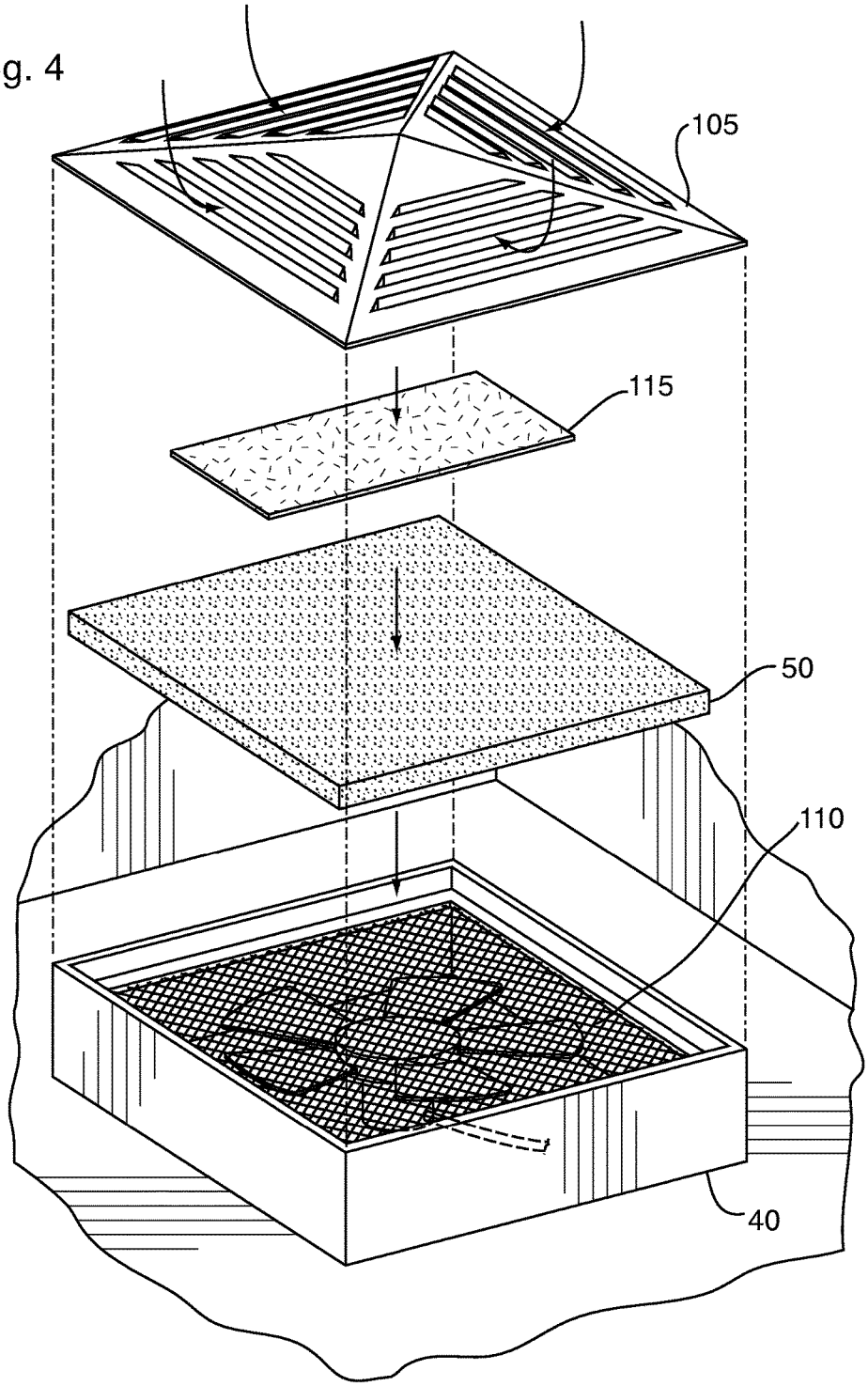
FIG. 4 is an exploded view of an embodiment of a filter holder of the present invention.
Figure 5:
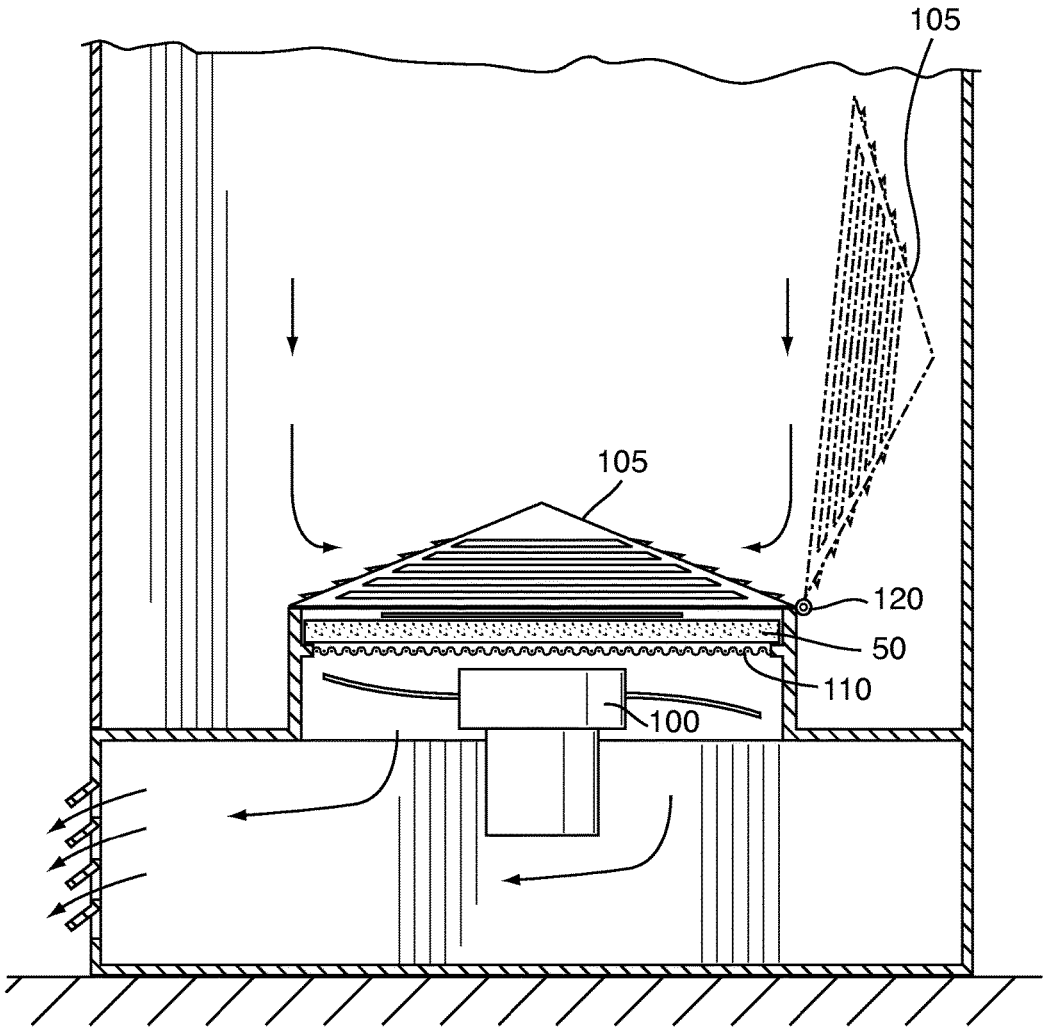
FIG. 5 is a side view of an embodiment of a filter holder of FIG. 4 showing the open and closed positions of a vent, and cut away to show the placement of a filter and a fan.

In an embodiment shown in FIGS. 1-3, the filter holder 40 includes a side filter vent 52 for sliding a filter into it as well as venting. Another embodiment of a filter holder with a top vent is shown in FIGS. 4-5.

In an embodiment, the filter holder is shown in the centre of the raised floor 32 and the fan is positioned below it. However, the filter holder may be positioned anywhere at the bottom and this may mean that equipment may be positioned differently to capture the air flow to best advantage. As well the raised floor 32 may be replaced with a raised platform surrounding the fan so that there is more room on either side of the filter holder for further storage. However, the raised floor 32 has aesthetic appeal, provides good air circulation for the fan, and ensures that the equipment is generally positioned above the fan.

FIG. 2 shows an embodiment of the wardrobe 5 in which the filter 50 is seen through a side filter vent 52. The wardrobe 5 can include a variety of bars, hooks and clamps for hanging equipment which may be modified to the specific sports equipment to be stored and dried. Equipment can be hung inside the wardrobe including on the inside doors such as an inside door hook 57, as well as on the outside on an outside hook 55; however, the equipment on the outside is only hung for storage and possibly general airing, but does not receive the advantage of the interior fan and filter system.

FIG. 3 shows an embodiment of a wardrobe of the present invention with horizontal bars, hooks and clamps and hockey equipment. In this embodiment, top hook 70 and top clamps 72 hang from the inside of the top 20 of the wardrobe 5, and insoles 73 may be hung on top clamps 72 and a hanger 75 with shoulder pads 77 can be hung on top hook 70.

The hanger 75 can be any hanger including a suit hanger to better hold and spread the shoulders of shoulder pads 77. An upper bar 60 can have mid hooks 80 (one hidden from view) for holding shin pads 82 and additionally have hooks for hockey pants (not shown). A lower bar 65 can have lower clamps 85 for holding gloves 87, and skate blade hooks 90 for holding skates 95. It is understood that any suspending means that will hold sports equipment and/or apparel may be used.

A hanger 75 in a further embodiment is replaced with a modified heavy duty hanger for spreading out the shoulder pads for airing better, or for holding the weight of heavier shoulder pads or a goalie chest protector. The clamps in the embodiment shown in FIGS. 1 to 3 can be replaced with hooks if the equipment is too heavy or slips out of clamps.

In an embodiment, an upper bar 60 can be moved forward towards the doors 15 for better drying of the pants below the shoulder pads or chest protector. Extra hooks on the inside doors are useful for drying under garments and socks.

The positioning of the equipment in FIG. 3 is arranged so that the wettest or hardest to dry equipment is closer to the fan.

FIGS. 1 to 3 show arrows to indicate the direction of air flow when the fan is turned on. Air is pulled into top vent 25, drawn down through the interior of the wardrobe, through side filter vent 52 of the filter holder 40 to pass through the filter 50, through the fan and out lower vent 35. Since the fan is at the bottom of the wardrobe 5 the most wet and hardest to dry equipment can be placed at the bottom of the wardrobe 5.

In another embodiment of the present invention (not shown), an upper bar 60 is moulded in the shape of a large suit hanger to properly rest and position the shoulders pads 77 to ensure open access to air for both the inside and outside panels of the shoulder pads. In this embodiment hockey pants are hung at the top from three hooks namely hook 70 attached at the rear and top of the wardrobe and two others (not shown) on either side of hook 70, to support and store the pants in an open position and directly in the downward draft of the air flow. Insoles and elbow pads are also hanging from the top of the wardrobe with a helmet in between; the insoles, elbow pads and helmet all hang in front of the pants.

The ambient heat in a home assists the drying activity. Using ambient heat rather than adding a heater, makes for a safe system. However, there is an embodiment of the invention described below which includes a heater. Air flow is improved when the wardrobe is fairly well sealed such that the fan draws the air from the top and it flows right down. Since heat naturally rises, pulling the warmer higher in through the top of the wardrobe to the bottom maximizes the benefit of the warm air. Warmer air is a relative term and the wardrobe of the present invention works in air conditioned homes as well.

In an alternative of the present invention, air could be drawn from the bottom to the top if a fan is placed at the top of a wardrobe, but this may result in longer dry times unless a warmer air is found at the bottom of the wardrobe, for example through the location of a forced air vent. If an embodiment of the present invention includes a body 10 with a wide bench shape, the fan can be placed at one side and the air could enter from a vent at the other side. Again, the drying time will be reduced if warmer air is entering the wardrobe.

FIGS. 1 to 2 show outside hooks 55 on the body of the wardrobe 5. The outside hooks 55 or other suspending means are included if needed, for example, for such items as goalie pads, sports bags and other equipment that does not have much if any sweat on it such as hockey and lacrosse sticks, skis, snowboards, ski poles.

FIGS. 4 to 5 show another embodiment of a filter holder of the present invention. The filter holder 40 has a grate 110 upon which a filter 50 rests and a top filter vent 105 allows air to enter from above the filter rather than from the side. Although it is not required, a scented dryer sheet 115 can be laid over the filter 50, which gives a scent to the air exhausted from the wardrobe 5. Likewise, an air freshener may be sprayed or suspended in the wardrobe if desired.

FIG. 5 additionally shows how the top filter vent 105 may include a hinge 120 to flip it open for replacing a filter 50 and/or scented dryer sheet 115. Alternatively, the top filter vent 105 may be placed on top of the filter holder 40 and simply be lifted off when the filter 50 and/or scented dryer sheet 115 are replaced.

FIGS. 4 to 5 show arrows to indicate the direction of air flow when the fan is turned on. Air enters the top filter vent 105, passes through filter 50, then the scented dryer sheet 115, through the grate 110 and out the lower vent 35.

The wardrobe 5 of the present invention can be made in a variety of dimensions. The following are examples of the potential sizes of wardrobe 5 which are described as tall for a larger higher wardrobe and short for a smaller shorter wardrobe. A tall wardrobe can be used to accommodate lots of equipment or larger equipment and a short wardrobe can be used for smaller equipment or for less equipment. A tall wardrobe could have the dimensions of 69 inch height, 20 inch depth and either 25 or 30 inch width.

The strength of a fan 100 can be varied depending on the size of the wardrobe. For example, a tall wardrobe could have a 70 CFM ("cubic feet per minute") fan for the 25 inch wide wardrobe and a 100 CFM fan for the 30 inch wide wardrobe. Of course every fan could have fan with high CFM, but that would not be energy conserving or cost sensitive.

A wider wardrobe of 30 inches can be used when the amount of equipment is greater or when the equipment itself is bigger, for example, for goalies. In an embodiment of a wardrobe for goalie equipment, the goalie gloves can be held with heavier duty hanging hooks, and goalie pants can be held open with additional hooks. In order to improve air flow to goalie pants, the upper bar 60 can be shifted forward. Given the size and weight of goalie pads, a heavy duty bar with a mounting bracket can be attached to the outer side of the wardrobe for hanging these heavy pads. A tall wardrobe of 69×20×30 inch wide is helpful for a goalie but also for two youths with hockey equipment. For two youths there are duplicate hooks and clamps since there are two sets of everything.

Wardrobes that are shorter are sufficient when less equipment is involved in a sport, or the equipment is for smaller people (e.g. children), or there is simply less space available as with apartments/condos. It is desirable to use the present invention to store and/or dry equipment that doesn't take up as much room, such as equipment used for activities like speed skating, figure skating, fitness, running, horse riding, cycling, and skateboarding. The smaller wardrobe can still fit an adult's hockey equipment too, although not providing as much space for air movement. A smaller wardrobe can be of any size that fits the equipment to store and/or dry, for example 35 inches high with a depth of 20 inches and a width of 25, 28 or 30 inches. The fan of such a smaller wardrobe can be 50 CFM or 70 CFM, particularly for the 30 inch width wardrobe.

In use, the present invention dries equipment quicker when the dampest or hardest to air equipment is placed near the bottom since that is the location of the fan. It is understood that if the fan were placed at the top of the wardrobe and vents were placed at the bottom for air intake, that such hard to dry equipment would be moved near the fan. In an example using hockey equipment as shown in FIGS. 1 to 3, skates and gloves are mounted above the fan; shin guards can be hung higher up; and elbow pads and insoles can hang from clips at the top of the wardrobe.

An active charcoal filter is used in order to trap and kill bacteria and the exhaust air released from the wardrobe is clean moist air without odour. An active charcoal filter may be replaced annually and can be of the size 7.5 inches by 8.5 inches which is a standard size that is available. It is understood that if other filters are presently available or developed which provide the characteristics of killing bacteria and trapping odour that they could also be used with the present invention, as well as charcoal filters of other dimensions. A scented dryer sheet is optional but is not required.

The fan used in the present invention can be any fan with an air displacement system that is preferably compact, has a high rate of airflow and is quiet. A bath ventilation fan has all of these qualities and is also designed to work in a moist environment, exchange the air, and remove any foul odours in a reasonable amount of time, and is compact and relatively quiet.

The present invention describes a drying wardrobe with the preferred features of: a fan at the bottom to draw naturally warmer air from an intake at the top and avoid the safety issue of a heater; a ventilation fan of 50-100 CFM; air exhaust at the bottom through the front of the wardrobe so that the wardrobe can be placed in any corner and still be capable of exhausting the air; and a charcoal filter for capturing odours.

The wardrobe of the present invention is filled with suspending means for hanging and holding articles for storing and/or drying and in an embodiment designed for drying and storing hockey equipment the suspending means are placed such that the skates and gloves are at the bottom closest to the fan and there is a moulded assembly above that for hanging and opening up the shoulder pads. Given that the rest of the equipment is either smaller or not as wet, it can be hung higher, for example, the shin pads can hang on either side of the shoulder pads; and the pants, helmet, elbow pads and insoles can be hung at the top under the air intake vent.

Although sports equipment is an especially large problem for which the present invention provides a solution, the present solution is also useful for drying any similar articles and articles of clothing, for example, after the washing machine. As well, the wardrobe of the present invention is useful for hanging clothes after work, particularly for workers in industries in which strong odours are emitted at the job site, or in which sweating occurs. The wardrobe can store, dry and contain odour from work pants, shirts and coveralls, and freshen those clothes for the next day's work.

The suspending means may be the bars, hangers, hooks and clamps described herein and any other means for holding or hanging an article in the wardrobe for airing, such as wire mesh shelves or hanging lines with clothespins etc.

The present invention typically comprises a fan selected from fans of 50-100 CFM. The strength of fan is related to the speed of drying. For example, a mid-range fan in the present embodiment of the invention is suitable for sports equipment with moderate usage and age. An average batch of hockey equipment from a player can be dried within 2 to 3 hours with a 70 CFM fan at 1680 rpm. With typical equipment under these parameters the air is exhausted into the room odour free.

However, with hockey equipment that has a smell that is overwhelming when in proximity to the equipment (for example, equipment used for ten or more years in which it was not dried properly), the strength of the smell from such hockey equipment is far too strong to be processed by the activated charcoal filtration system within the air circulation system with a fan of 70 CFM. Under these conditions, the air may be emitted with an undesirable odour. In such a case it is desirable for the fan to be of lower CFM so that the air circulates more slowly and smelly air is not emitted. For example, a fan of 50 CFM, would be suited to very smelly equipment.

However, if the present invention has a 70 RPM fan, it can be adapted as described herein in a further embodiment of the invention in order to handle both regular and extremely smelly sports equipment. For example, this further embodiment of the present invention can still utilize a 70 CFM fan with a speed of 1680 RPM; however, in addition there is a variable speed switch for the fan.

The variable speed switch can reduce the amount of electricity that flows to the fan motor, thus allowing the speed to be reduced when desired. Reducing the fan's speed adjusts the rate of air flow through the activated charcoal filter and therefore undesirable odour is not emitted out of the drying wardrobe. The fan speed is adjusted by turning a knob on the variable speed switch, namely adjusted until the air being emitted is odour free air, and once the maximum speed is determined by the user the variable speed switch is left in that position for future use and from thereafter acts as an "On-Off" switch.

In an example of the variable speed embodiment, the speed of a 70 CFM fan is reduced using the variable speed switch to operate at a rate of about 1,000 to 1,200 RPM. The result of reducing the speed of the fan is to extend the drying time. For example, the drying time for very smelly equipment at reduced fan speed of 1,000 to 1,200 RPM is about 3 to 4 hours instead of the 2 to 3 hours for average smelly equipment.

This variable speed embodiment of the drying wardrobe can be used for any type of equipment or items for drying and it allows the user to adjust the drying time of the items in the drying wardrobe as desired. As such, the variable speed embodiment provides a custom drying option.

In a further embodiment of the present invention, a heater is added to the wardrobe, which is especially helpful when there is no ambient heat, such as when the wardrobe is situated in a cold place, such as, a garage, shed, or basement. The heater can be put on a timer so that it can be left to dry or so that equipment or clothes can be warmed up just prior to use. As well, when the heater is used, the top vent 25 can be closed so that air only goes through the heater rather than sucking in cold air, which is different circulation flow. The Heater may be placed at the back of the hard top 240 and ¾ of the heater can be in the inner cavity with an air intake vent protruding from the wardrobe at the top rear.

A further embodiment of the present invention as set out in FIGS. 6 to 16, is a flexible wardrobe, "flexible" meaning that it is made of material that is flexible rather than rigid material. The flexible wardrobe can be packable for ease of transportation. The flexible wardrobe can be hung or stand on its own. The flexible wardrobe can include both wardrobe hanging means and also include an optional pole support kit, such that it can interchangeably hang or stand when the pole support kit is installed. Again, the fan is capable of being on a timer in order to set the duration for which the fan is on. When a three speed fan is use, the fan switch is one that can be used for a three speed fan. Three speed fans are helpful when it is desired to set to a quieter setting, for example, in a hotel room when sleeping beside the wardrobe.

The material of the flexible wardrobe embodiment can be similar to a hockey bag or mining fabric which is water resistant and non-breathable on the outside, due to the specialized plasticized coating added to the interior panel of the wardrobe fabric, so that odours and moisture on the inside of the flexible wardrobe generally remain inside the wardrobe when it is closed up. The air circulation system circulates warm air by the damp/moist equipment/clothing contained within, and the moist air exhausted will be passed through an active charcoal filter to trap the odour causing bacteria.

Figure 6:
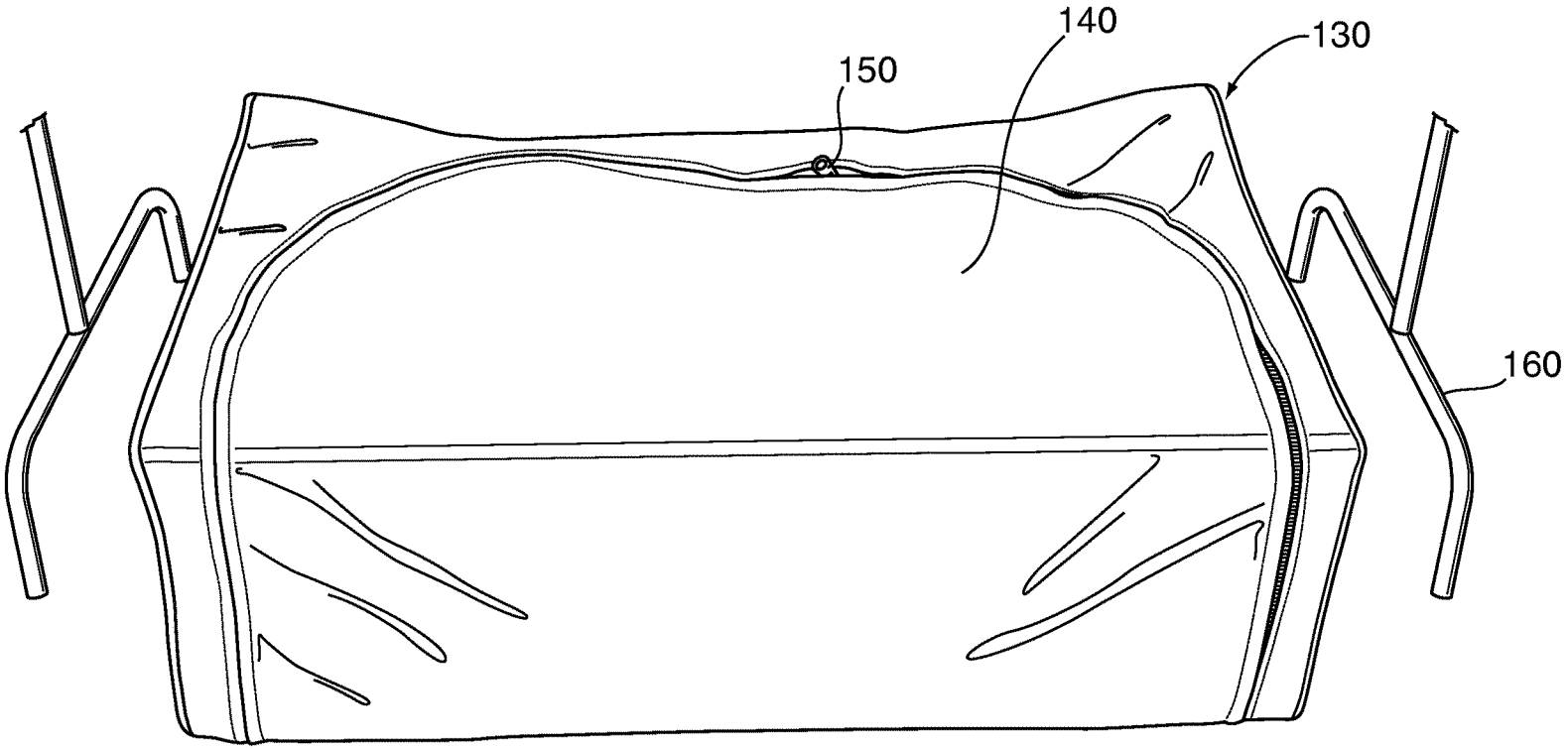
FIG. 6 is a front view of an embodiment of a flexible packable wardrobe of the present invention in packed configuration.
Figure 7:
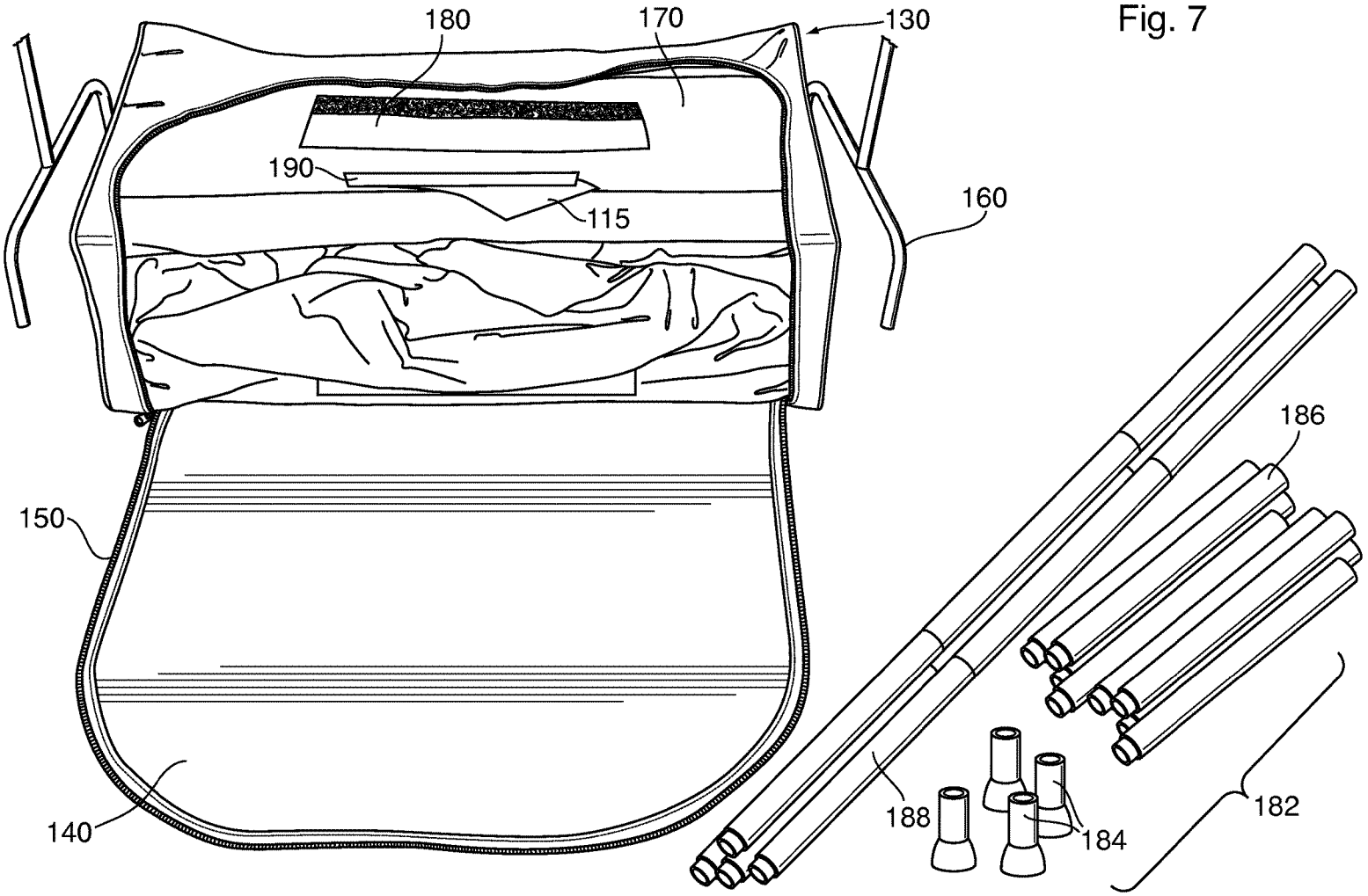
FIG. 7 is a front view of an embodiment of a flexible packable wardrobe of the present invention in first step to opening, with an optional pole kit.

FIG. 6 is an embodiment of a packable flexible wardrobe 130 of the present invention in packed configuration in which a first flap 140 is closed via first zipper means 150. FIG. 7 shows the first step to unpacking the packable flexible wardrobe 130 in which when the first flap 140 is open the soft top 170 with an optional wardrobe hanging means 180 is visible. The soft top 170 is mesh or another type of fabric which allows for the passage of air and optionally includes a slot 190 which allows the placement of a dryer added sheet (or other air permeable favorable smelling sachet and the like) under the soft top 170.

An optional pole support kit 182 may also be stored under the first flap 140 and removed when opened, or may be provided with a flexible wardrobe. The pole support kit 182 comprises feet 184, pole segments 186 wherein three pole segments 186 fit together to form pole 188.

Figure 8:
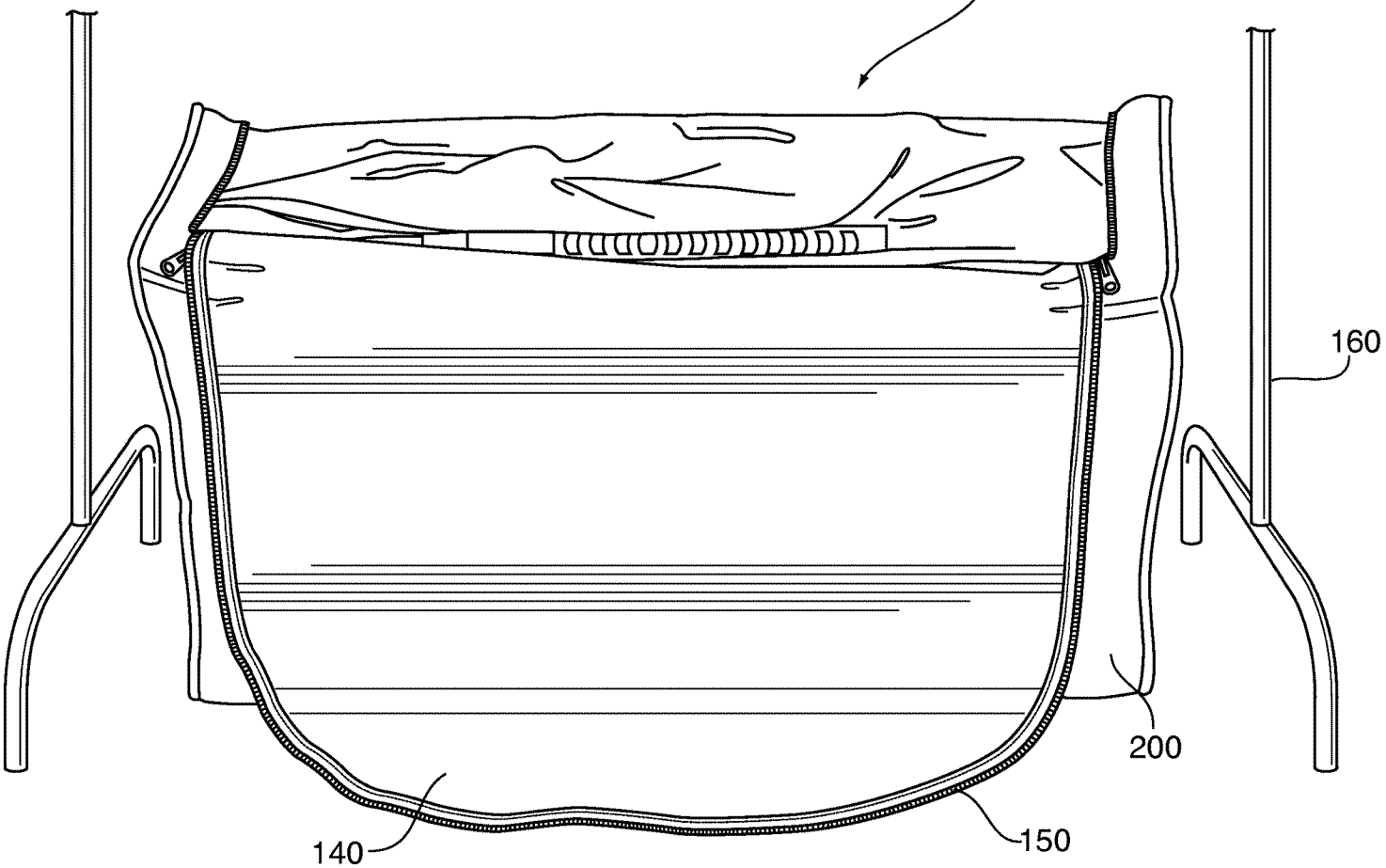
FIG. 8 is a front view of an embodiment of a flexible packable wardrobe of the present invention in second step to opening.
Figure 9:
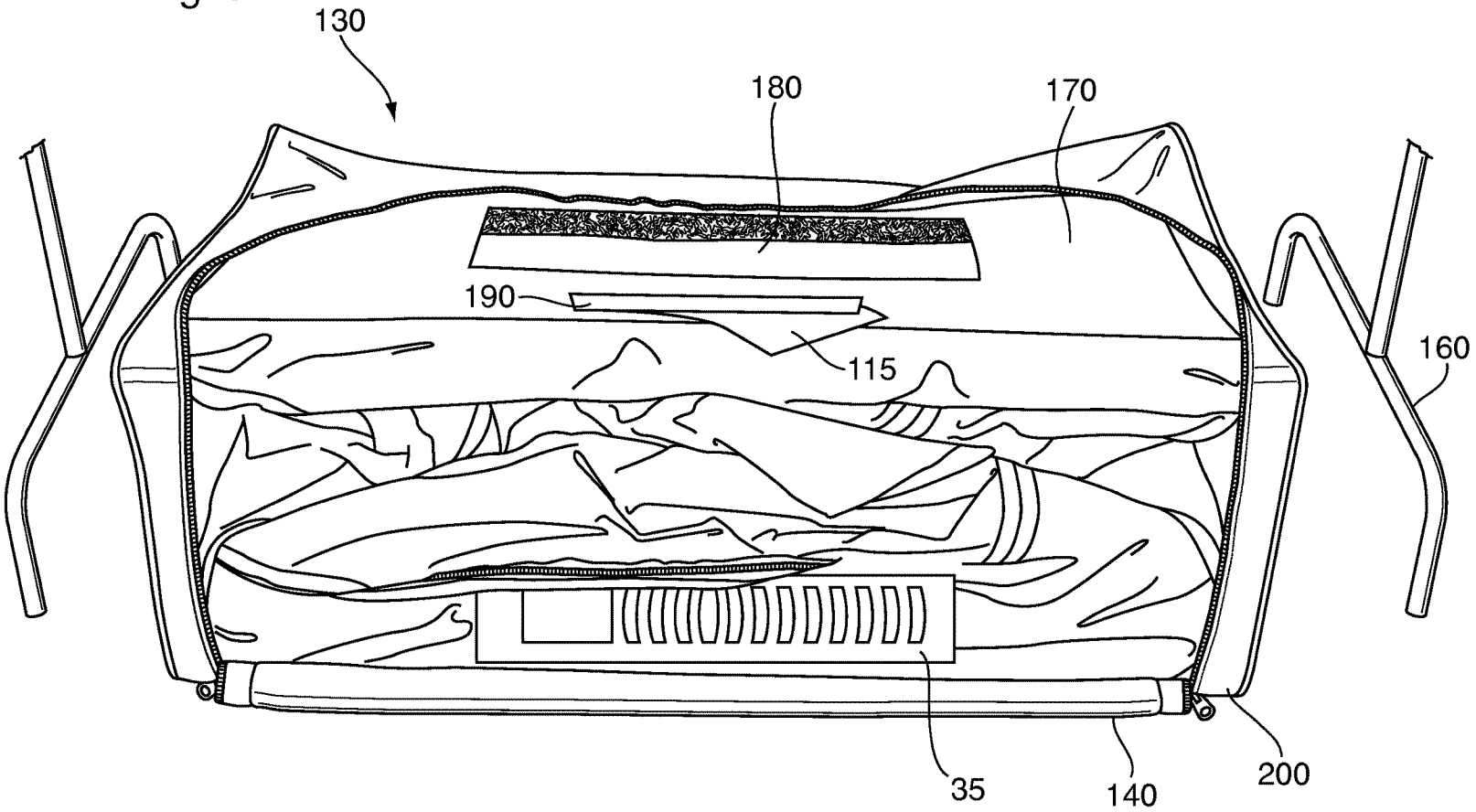
FIG. 9 is a front view of an embodiment of a flexible packable wardrobe of the present invention in third step to opening.

FIGS. 8 and 9 demonstrate optional second and third steps to unpacking in order to tuck away first flap 140. FIG. 8 demonstrates a second step in which the packable flexible wardrobe 130 is flipped up and the first flap 140 lies against the soft bottom 200. FIG. 9 demonstrates a third step in which the packable flexible wardrobe 130 is flipped back down thus hiding away the first flap 140.

Figure 10:
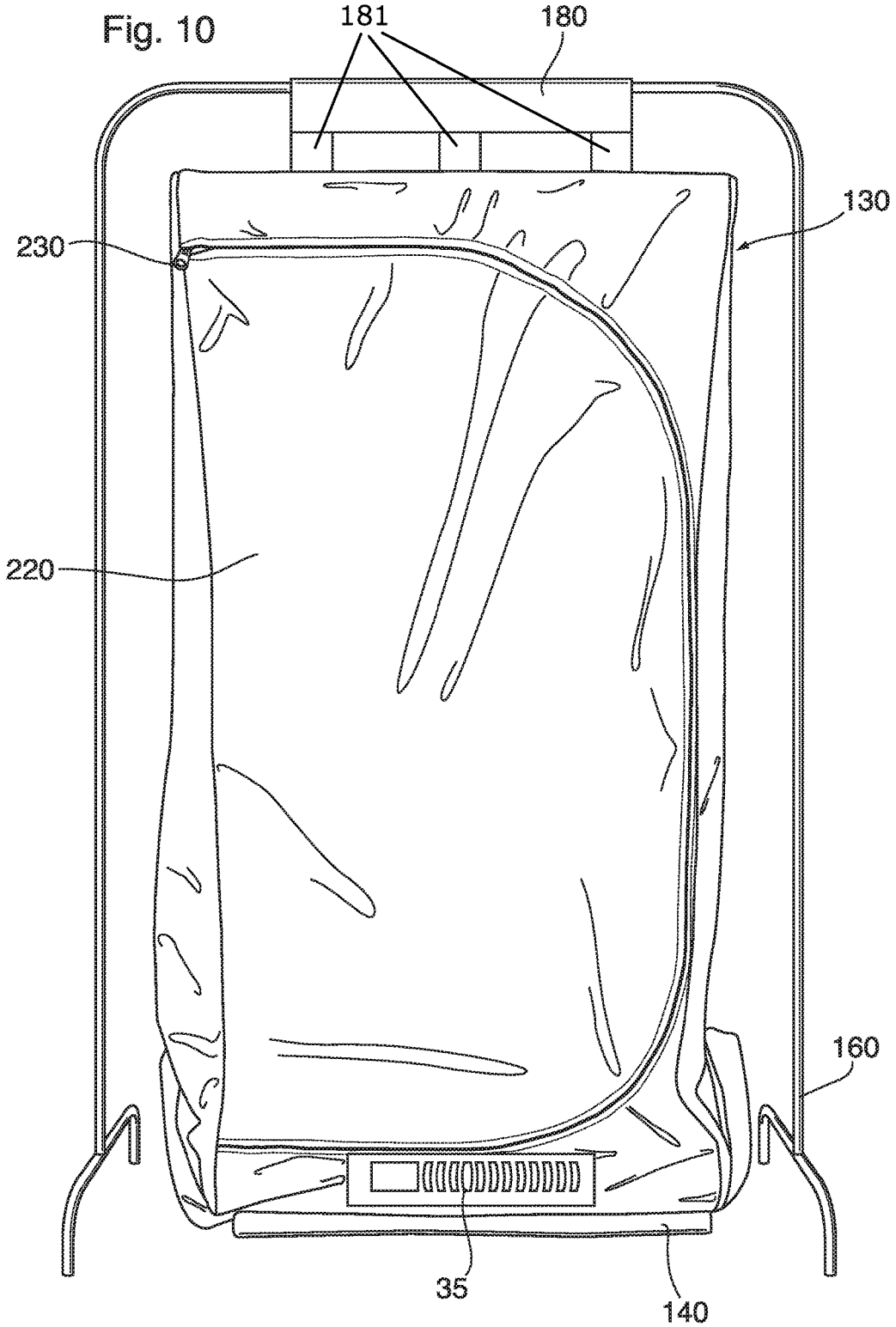
FIG. 10 is a front view of an embodiment of a flexible packable wardrobe of the present invention closed in unpacked configuration.

FIG. 10 shows the flexible packable wardrobe 130 of the present invention in unpacked configuration and hanging from a hanging rod apparatus 160 by the wardrobe hanging means 180. The wardrobe hanging means 180 may be any means that allows a flexible wardrobe to hang, but should be strong enough to bear the weight of the items that will be hung in the flexible wardrobe. In this example, the wardrobe hanging means 180 is a bar of fabric with three Velcro® straps or removably interlocking fastening tapes 181. The flexible wardrobe 130 has an access flap 220 closed by a second zipper means 230. The lower vent 35 vents a fan (not shown) which is turned on or off by a switch (not shown) via button 45. A timer or a three speed variable switch can alternatively be provided.

Figure 11:
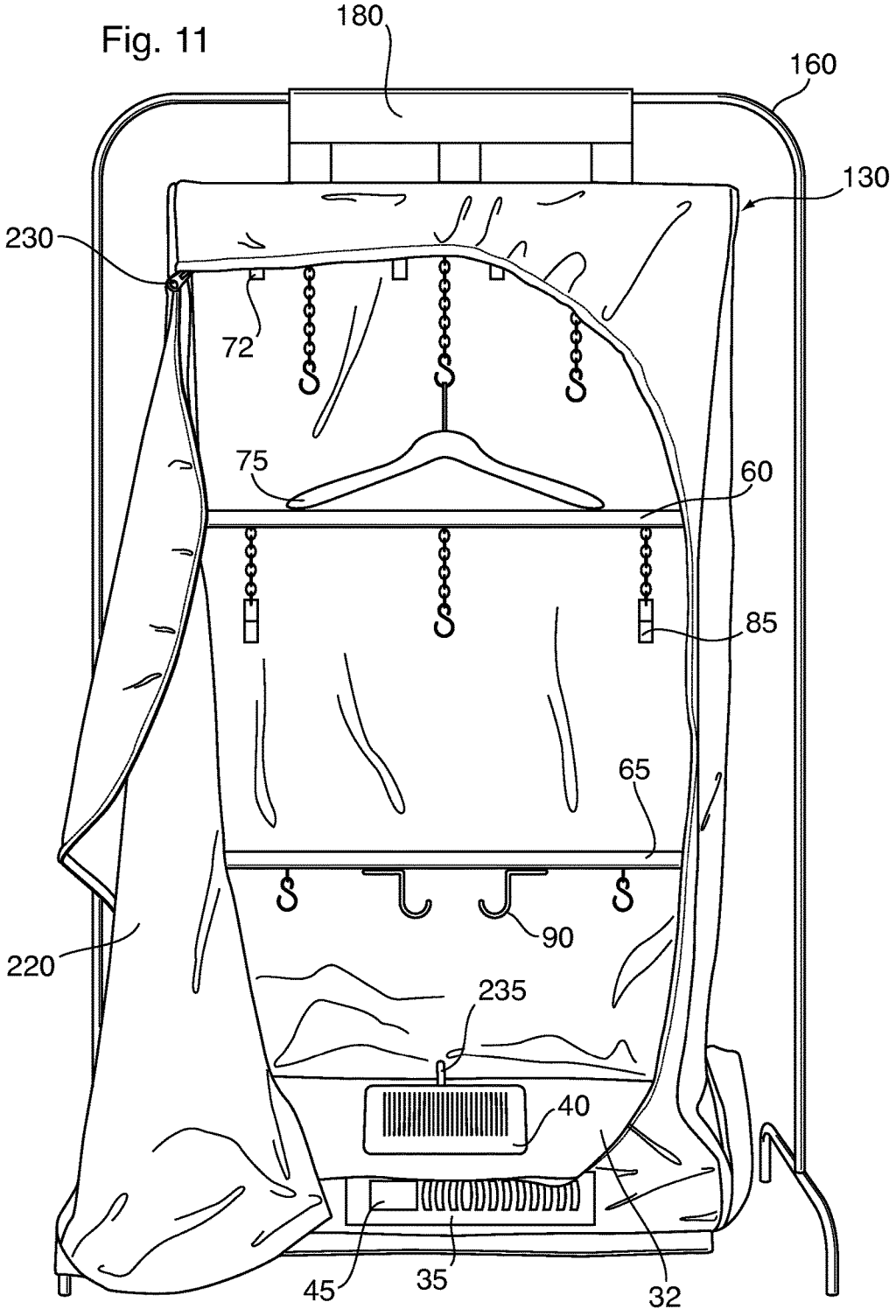
FIG. 11 is a front view of an embodiment of a flexible packable wardrobe of the present invention open in unpacked configuration.

FIG. 11 shows the flexible packable wardrobe 130 of the present invention in unpacked configuration with access flap 220 open via zipper means 230. The floor 32 has the filter cover 40 which covers the filter (not shown). A power cord 235 which provides power to the fan is showing in this embodiment, but can also be hidden away. As in the hard wardrobe of the present invention, the flexible wardrobe can include a variety of bars, hooks and clamps for hanging sports equipment and clothes or whatever is desired to be aired, dried or stored.

Figure 12:
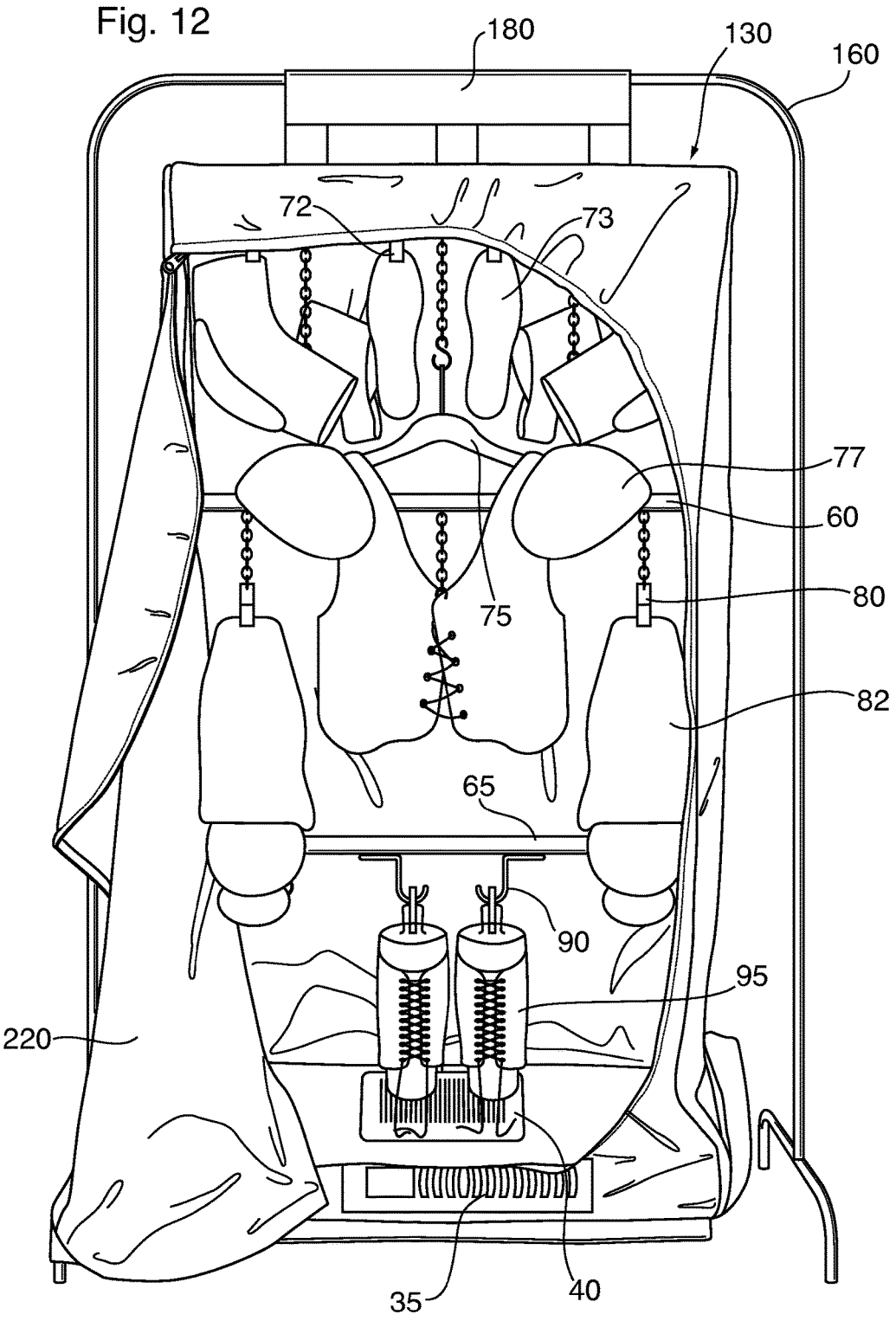
FIG. 12 is a front view of an embodiment of a flexible packable wardrobe of the present invention open in unpacked configuration with hockey equipment.

As shown in FIG. 12, various hockey equipment can be aired, dried or stored in the flexible wardrobe, such as, top clamps 72 with insoles 73 and a hanger 75 with shoulder pads. An upper bar 60 can have mid clamps 80 for holding shin pads 82. A lower bar 65 can have skate blade hooks 90 for holding skates 95. It is understood that any suspending means that will hold sports equipment and/or apparel may be used.

Figure 13:
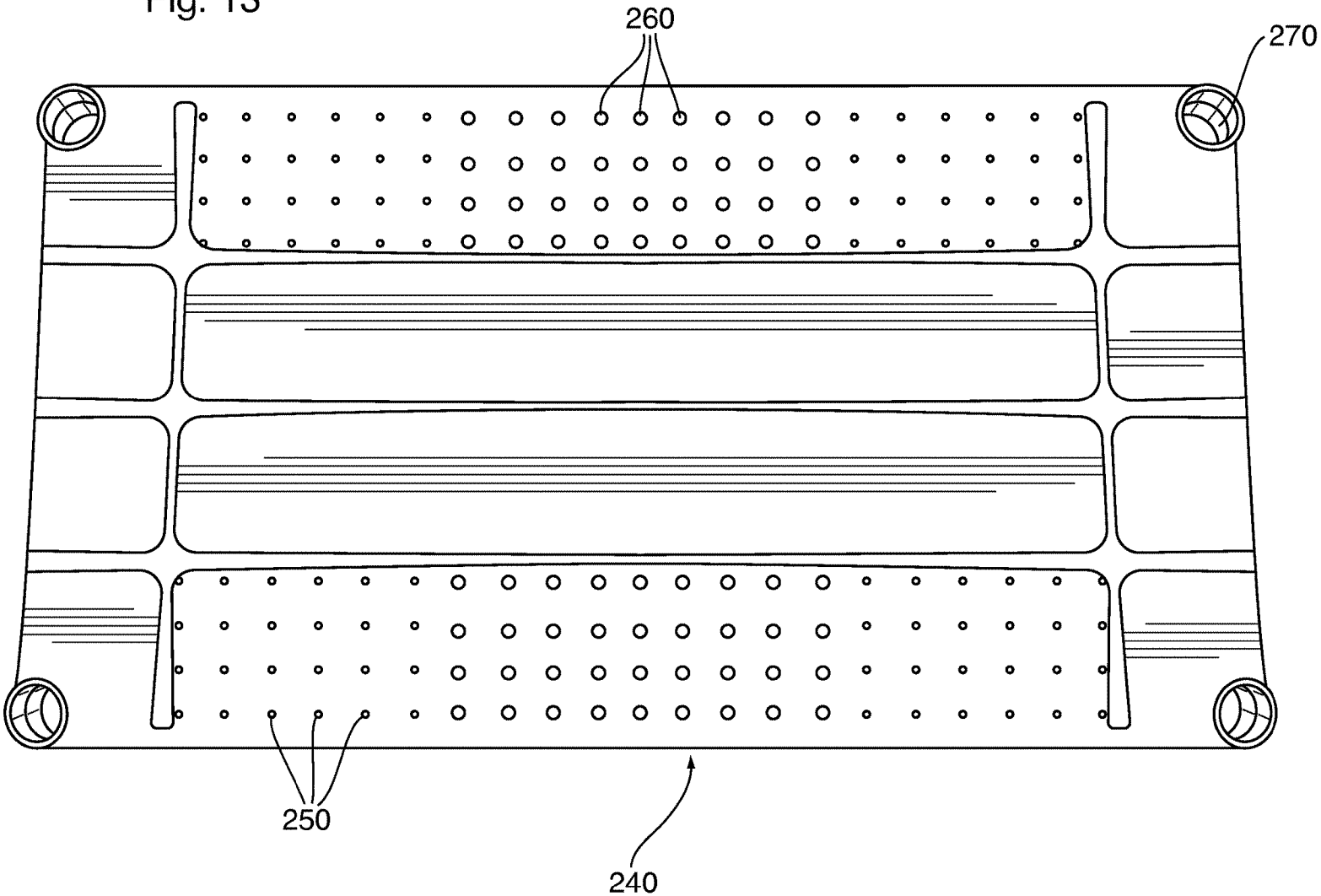
FIG. 13 is a top view of an embodiment of a hard top of an embodiment of a flexible wardrobe of the present invention.

FIG. 13 is a top view of a hard top 240 of a flexible wardrobe of the present invention which is not seen in the previous figures since it is covered by soft top 170. The hard top 240 allows air to permeate into the wardrobe by means of first ventilation holes 250 and optionally there are second ventilation holes 260 which are larger such that when a dryer added sheet is placed over these holes, the air still travels at about the same rate as through the first ventilation holes. As will be understood this is not required but if it is desired to use a dryer added sheet or scented sheet or sachet, then the second ventilation holes 260 of a larger diameter maintain the air circulation rate. Two dryer added sheets may be placed in the cabinet in the front and rear over the two sets of second ventilation holes 260.

Optionally there are top corner holes 270 in the hard top 240 which enable a flexible wardrobe to stand on its own rather than hang, which will be described below.

Figure 14:
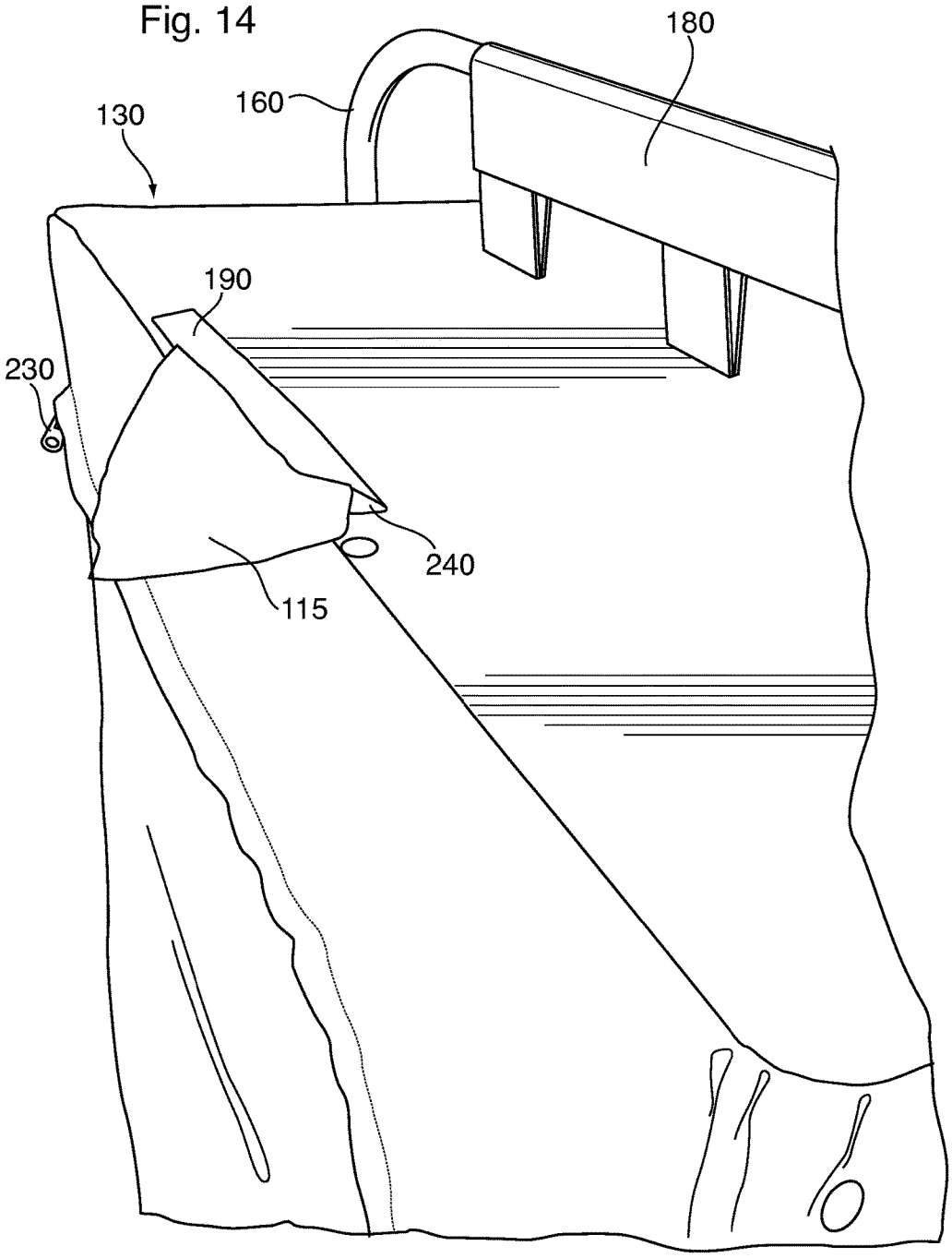
FIG. 14 is a perspective view of an embodiment of a soft top of a flexible wardrobe of the present invention.

FIG. 14 shows the soft top 170 with the wardrobe hanging means 180 and slot 190, and in this embodiment there is another slot at the rear which is not visible in the drawing. Although it will be understood that the hard top could be adapted to serve all the necessary or desired functions, the soft top is aesthetically pleasing and the slot 190 allows a scented sheet to be inserted in between the soft top 170 and the hard top 170.

Figure 15:
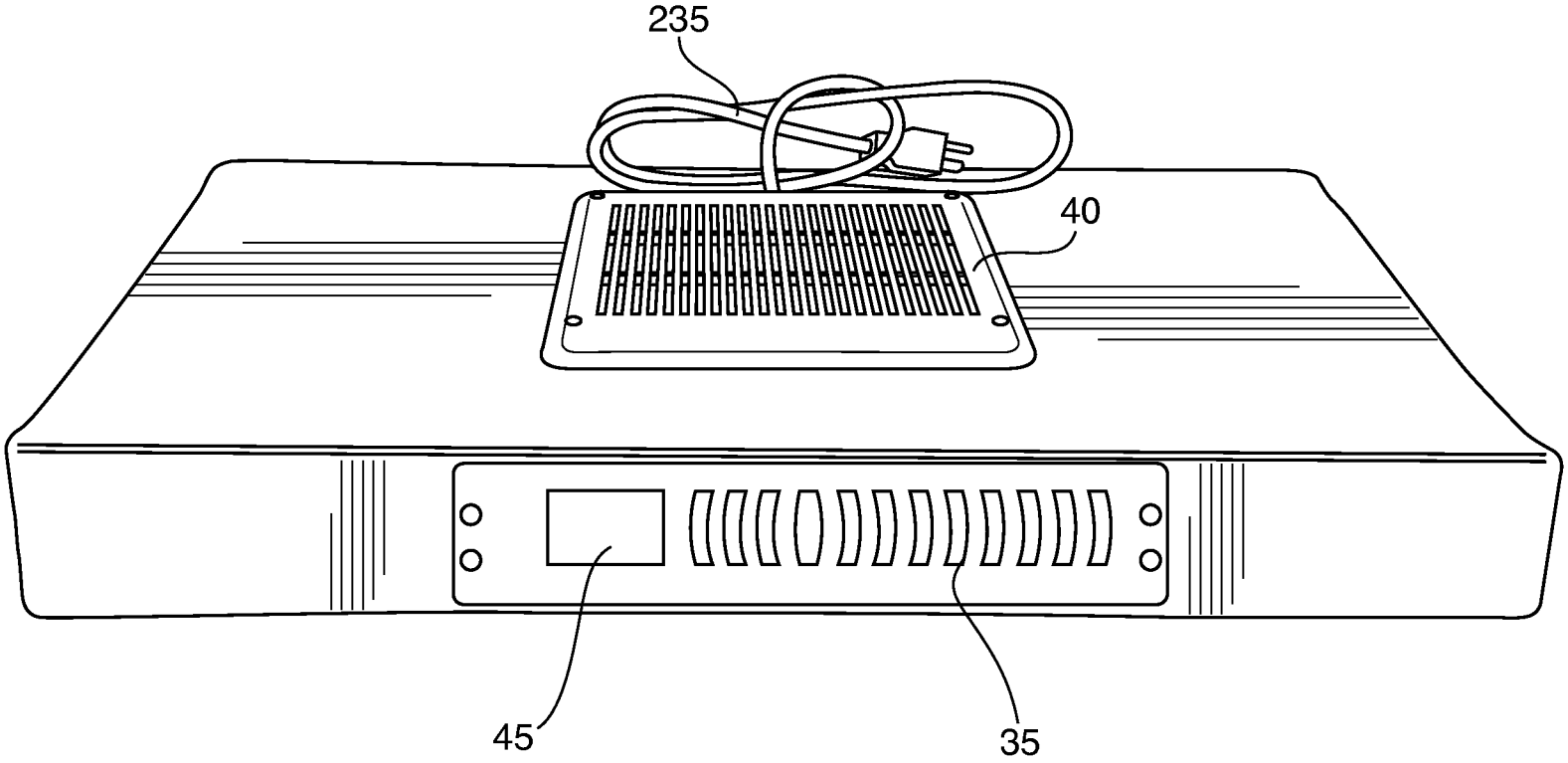
FIG. 15 is a perspective view of an embodiment of a hard bottom of a flexible wardrobe.

FIG. 15 is a perspective view of an embodiment of a hard bottom 280 of a flexible wardrobe in which a dryer added sheet 115 can be placed under the soft top 170 in the location of the second ventilation holes 260 (shown in detail in FIG. 13).

Figure 16:
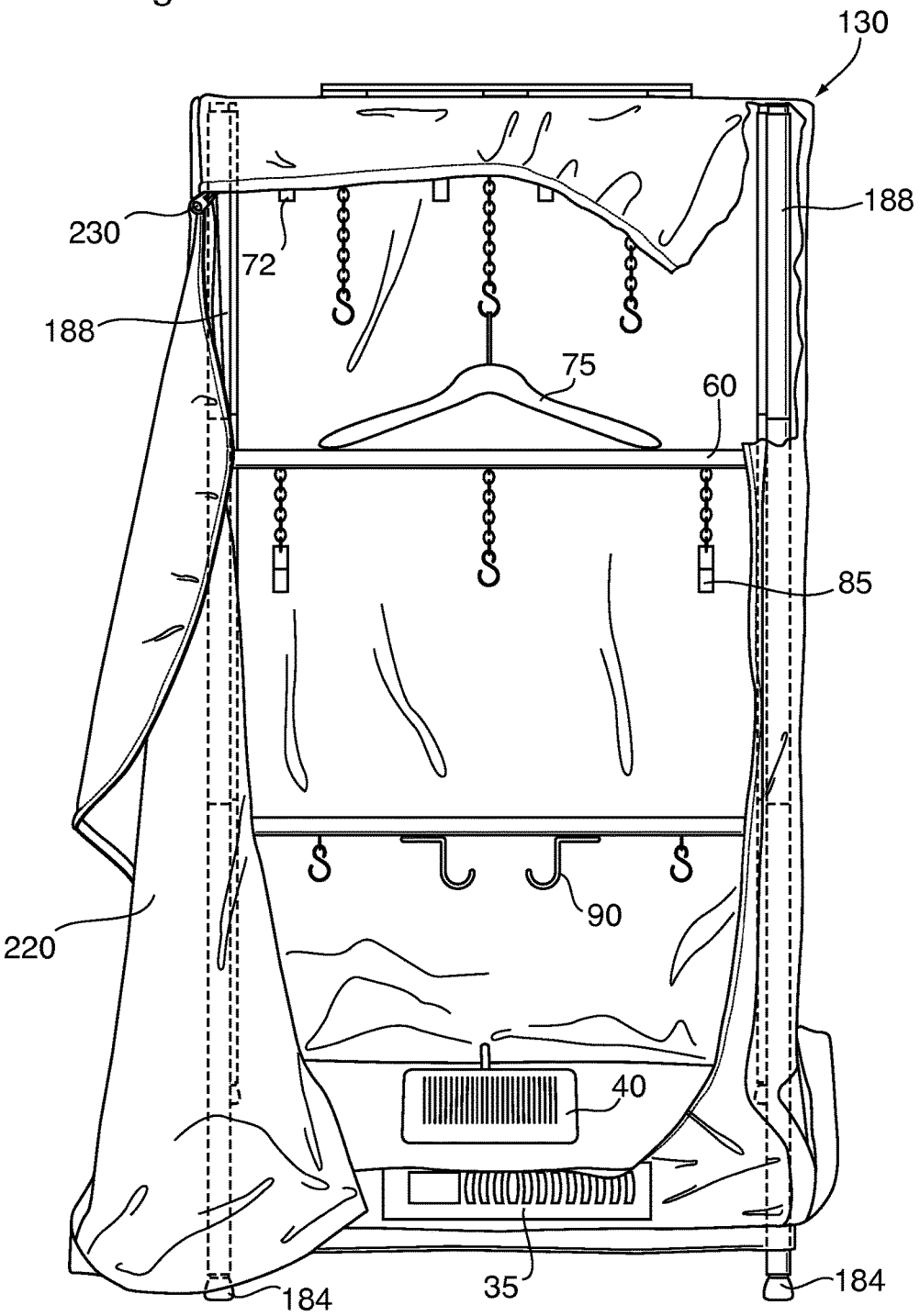
FIG. 16 is a front view of an embodiment of a flexible wardrobe with support poles.

FIG. 16 shows a flexible wardrobe standing on feet 184 with support poles 188. In this embodiment the wardrobe hanging means 180 is also shown since it is then an option to use support poles or hanging. The support poles could be used in a permanent manner with no wardrobe hanging means in another embodiment.

Figure 17:
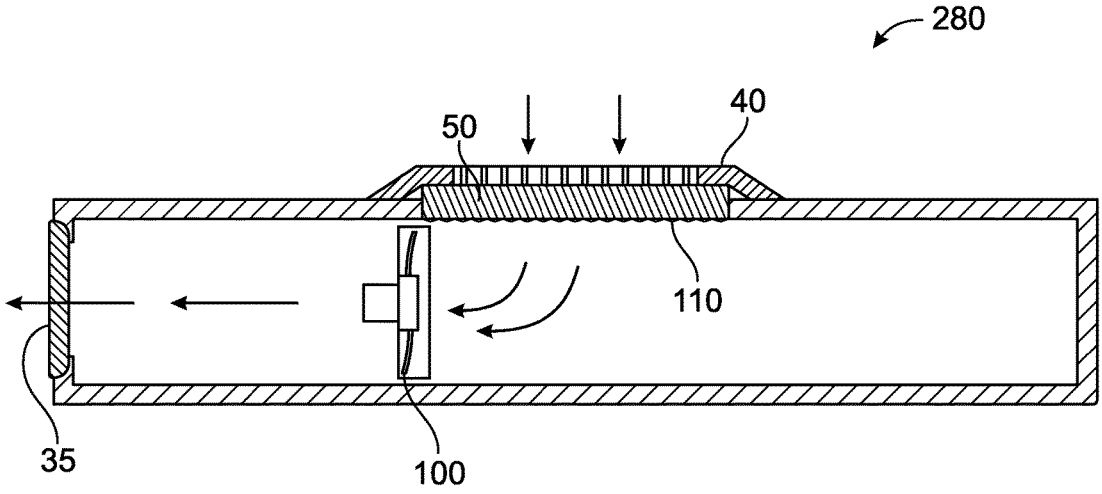
FIG. 17 is a cross-sectional view of an embodiment of a hard bottom of a flexible wardrobe.

FIG. 17 shows a cross-sectional view of an embodiment 280 of a hard bottom similar to that in FIG. 15. In this embodiment 280 of the hard bottom in a flexible wardrobe, air is drawn from the inner cavity by the circulation fan 100, through the filter cover 40, the filter 50, the grate 110, and then to the exhaust vent 35.

While embodiments of the invention have been described in the detailed description, the scope of the claims should not be limited by the preferred embodiments set forth in the examples, but should be given the broadest interpretation consistent with the description as a whole.

What is claimed is:

1. A wardrobe having a flexible inner cavity extending from a top of the wardrobe to a bottom of the wardrobe, said wardrobe comprising:

an air intake vent at the top;

an air exhaust vent at the bottom;

an air circulation fan at the bottom;

at least one access to the inner cavity, said access being capable of being opened and closed; and a mesh cover above the air intake vent, the mesh cover comprising one or more slots sized for insertion of scented sheets, wherein the air intake vent comprises a hard panel with ventilation holes that are larger at the slots.

2. The wardrobe of claim 1, further comprising a wardrobe hanging member at the top of the wardrobe, configured to hang the wardrobe.

3. The wardrobe of claim 2, wherein the wardrobe hanging member further comprises a bar of fabric held closed by one or more removably interlocking fastening tapes.

4. The wardrobe of claim 1, further comprising support poles within the inner cavity resting on support feet under the bottom of the wardrobe.

5. The wardrobe of claim 1, further comprising a packing bag integral to the wardrobe in which the wardrobe fits, wherein a bottom of the packing bag is also the bottom of the wardrobe.

6. The wardrobe of claim 5, further comprising a wardrobe hanging member at the top of the wardrobe, configured to hang the wardrobe.

7. The wardrobe of claim 6, further comprising a kit containing support poles and support feet.

8. The wardrobe of claim 6, wherein the wardrobe hanging member further comprises a bar of fabric held closed by one or more removably interlocking fastening tapes.

9. A method of drying one or more articles comprising the steps of:

hanging one or more articles in a flexible inner cavity extending from a top of a wardrobe to a bottom of the wardrobe, said wardrobe comprising:

at least one access to the inner cavity, said access capable of being opened and closed, an air circulation fan and an exhaust vent at the bottom of the wardrobe, an intake vent at the top of the wardrobe, and a mesh cover above the air intake vent, the mesh cover comprising one or more slots sized for insertion of scented sheets, wherein the air intake vent comprises a hard panel with ventilation holes that are larger at the slots;

closing the access; and turning on the fan.

10. A wardrobe having a flexible inner cavity extending from a top of the wardrobe to a bottom of the wardrobe, said wardrobe comprising:

an air intake vent at the top;

an air exhaust vent at the bottom;

an air circulation fan at the bottom;

at least one access to the inner cavity, said access being capable of being opened and closed;

a packing bag integral to the wardrobe in which the wardrobe fits; and a mesh cover above the air intake vent, the mesh cover comprising one or more slots sized for insertion of scented sheets, wherein a bottom of the packing bag is also the bottom of the wardrobe; and the air intake vent comprises a hard panel with ventilation holes that are larger at the slots.

* * * * *